US007341043B2

(12) United States Patent
Kurata et al.

(10) Patent No.: US 7,341,043 B2
(45) **Date of Patent: *Mar. 11, 2008**

(54) FUEL SUPPLY SYSTEM OF INTERNAL COMBUSTION ENGINE AND INTERNAL COMBUSTION ENGINE

(75) Inventors: Naoki Kurata, Aichi-ken (JP); Mitsuto Sakai, Toyota (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 0 days.

This patent is subject to a terminal disclaimer.

(21) Appl. No.: 11/134,302

(22) Filed: May 23, 2005

(65) Prior Publication Data

US 2006/0000455 A1 Jan. 5, 2006

(30) Foreign Application Priority Data

Jun. 30, 2004 (JP) ..... 2004-193319

(51) Int. Cl.
*F02B 7/00* (2006.01)
*F02B 7/02* (2006.01)

(52) U.S. Cl. ..... 123/431; 123/456

(58) Field of Classification Search ..... 123/431, 123/456, 447, 304, 514
See application file for complete search history.

(56) References Cited

U.S. PATENT DOCUMENTS 4,096,995 A * 6/1978 Klomp ..... 239/94
5,924,405 A * 7/1999 Hashimoto ..... 123/431
6,823,846 B2 * 11/2004 Mattes ..... 123/456
2002/0092504 A1 * 7/2002 Kohketsu et al. ..... 123/447
2004/0003796 A1 1/2004 Nomura
2004/0118116 A1 * 6/2004 Beck et al. ..... 60/601
2005/0098155 A1 * 5/2005 Yamazaki et al. ..... 123/431
2005/0115545 A1 * 6/2005 Kawasaki et al. ..... 123/456
2005/0193981 A1 * 9/2005 Sakai et al. ..... 123/431
2005/0193982 A1 * 9/2005 Sakai et al. ..... 123/431
2005/0235958 A1 * 10/2005 Matsumura ..... 123/431
2005/0241617 A1 * 11/2005 Kojima ..... 123/446
2005/0274353 A1 * 12/2005 Okubo et al. ..... 123/299

FOREIGN PATENT DOCUMENTS

DE 295 18 733 U 1 4/1997
DE 19941770 * 3/2001
DE 10 2004 027 507 A1 12/2005
EP 1 180 595 A2 2/2002
JP 53-147125 12/1978
JP A 07-004330 1/1995
JP A 07-103048 4/1995
JP A 07-109962 4/1995
JP A 2001-214828 8/2001

* cited by examiner

*Primary Examiner*—Mahmoud Gimie
(74) *Attorney, Agent, or Firm*—Oliff & Berridge, PLC

(57) ABSTRACT

A fuel supply system according to the present invention includes a first delivery pipe for intake passage injection and a second delivery pipe for cylinder injection. The second delivery pipe is provided with a relief valve. A fuel discharge section of the relief valve is connected to the first delivery pipe via a relief passage.

11 Claims, 4 Drawing Sheets

Fuel Temperature
0

Fuel Pressure
0
Saturated Vapor Pressure
t1
Time

FUEL SUPPLY SYSTEM OF INTERNAL COMBUSTION ENGINE AND INTERNAL COMBUSTION ENGINE

BACKGROUND OF THE INVENTION

The present invention relates to a fuel supply system of an internal combustion engine that includes a delivery pipe provided with a relief valve, which discharges fuel when being opened, and to the internal combustion engine.

Japanese Laid-Open Patent Publication No. 7-103048 discloses an internal combustion engine that distributes fuel accumulated in a delivery pipe to injectors of cylinders. In an internal combustion engine in which the fuel pressure in a delivery pipe is high, for example, in an in-cylinder injection gasoline engine or a common rail diesel engine, a relief valve, which discharges accumulated fuel on an as needed basis, is located in the delivery pipe to prevent excessive increase of the fuel pressure in the delivery pipe.

According to the delivery pipe in which the relief valve is provided, air easily enters the delivery pipe when the engine is not operating. That is, if flow of fuel in and out of the delivery pipe is stopped when the engine is not operating, the fuel temperature in the delivery pipe temporarily increases due to the residual heat of the internal combustion engine. At this time, in the delivery pipe in which the relief valve is provided, increase of the internal pressure of the delivery pipe due to the thermal expansion of fuel causes the relief valve to be opened and part of fuel in the delivery pipe to be discharged. If the temperature of the residual fuel is decreased in accordance with decrease of the temperature of the internal combustion engine in a state where the amount of the residual fuel in the delivery pipe has been decreased, the internal pressure of the delivery pipe is significantly decreased causing air to enter the delivery pipe from a gap in the relief valve. If an operation for restarting the internal combustion engine is started in this state, that is, when the restarting operation is started with air in the delivery pipe, a time required for increasing the fuel pressure in the delivery pipe for preparation of starting the engine is increased as compared to a case where air is not in the delivery pipe.

In an in-cylinder injection internal combustion engine, since the fuel pressure required for fuel injection is high, the delivery pipe is located in the vicinity of a cylinder block. Therefore, in the in-cylinder injection internal combustion engine, the temperature of residual fuel is easily increased after the internal combustion engine is stopped. Thus, the problem is more serious.

SUMMARY OF THE INVENTION

Accordingly, it is an objective of the present invention to provide a fuel supply system of an internal combustion engine and an internal combustion engine that suppress air from entering a delivery pipe when the engine is not operating.

To achieve the foregoing and other objectives and in accordance with the purpose of the present invention, a fuel supply system of an internal combustion engine including a delivery pipe with a relief valve is provided. The fuel supply system includes a maintaining device, which maintains a fuel discharge section of the relief valve filled with fuel when the engine is not operating.

The present invention provides also an internal combustion engine having a plurality of cylinders and intake passages each of which connected to one of the cylinders. The internal combustion engine includes first injectors, second injectors, a first delivery pipe, a second delivery pipe, a relief valve, a relief passage, and a maintaining device. Each first injector injects fuel in one of the intake passages. Each second injector injects fuel in one of the cylinders. The first and second injectors are used independently or in combination. The first delivery pipe distributes fuel to the first injectors. The second delivery pipe distributes fuel to the second injectors. The relief valve is provided on the second delivery pipe. The relief passage connects the relief valve to the first delivery pipe. The maintaining device maintains a fuel discharge section of the relief valve filled with fuel when the engine is not operating.

The present invention provides another internal combustion engine having a plurality of cylinders and intake passages each of which connected to one of the cylinders. The internal combustion engine includes first injectors, second injectors, a first delivery pipe, a second delivery pipe, a relief valve, a fuel tank, a relief passage, and a maintaining device. Each first injector injects fuel in one of the intake passages. Each second injector injects fuel in one of the cylinders. The first and second injectors are used independently or in combination. The first delivery pipe distributes fuel to the first injectors. The second delivery pipe distributes fuel to the second injectors. The relief valve is provided on the second delivery pipe. The relief passage connects the relief valve to the fuel tank. The maintaining device maintains a fuel discharge section of the relief valve filled with fuel when the engine is not operating. At least part of the relief passage is located higher than the relief valve, and the maintaining device is configured of the at least part of the relief passage.

The present invention provides yet another internal combustion engine having a plurality of cylinders and intake passages each of which connected to one of the cylinders. The internal combustion engine includes first injectors, second injectors, a firs delivery pipe, a second delivery pipe, a relief valve, a fuel tank, a relief passage, and a maintaining device. Each first injector injects fuel in one of the intake passages. Each second injector injects fuel in one of the cylinders. The first and second injectors are used independently or in combination. The first delivery pipe distributes fuel to the first injectors. The second delivery pipe distributes fuel to the second injectors. The relief valve is provided on the second delivery pipe. The relief passage connects the relief valve to the fuel tank. The maintaining device maintains a fuel discharge section of the relief valve filled with fuel when the engine is not operating. The relief passage is provided with a check valve, and the maintaining device is configured of the check valve.

Other aspects and advantages of the invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings.

FIG. 3(*b*) is a timing chart showing changes of the fuel pressure in the in-cylinder injection delivery pipe;

DETAILED DESCRIPTION OF THE PREFERRED EMBODIMENTS

A fuel supply system of an internal combustion engine according to one embodiment of the present invention will be described with reference to the drawings.

Figure 1:
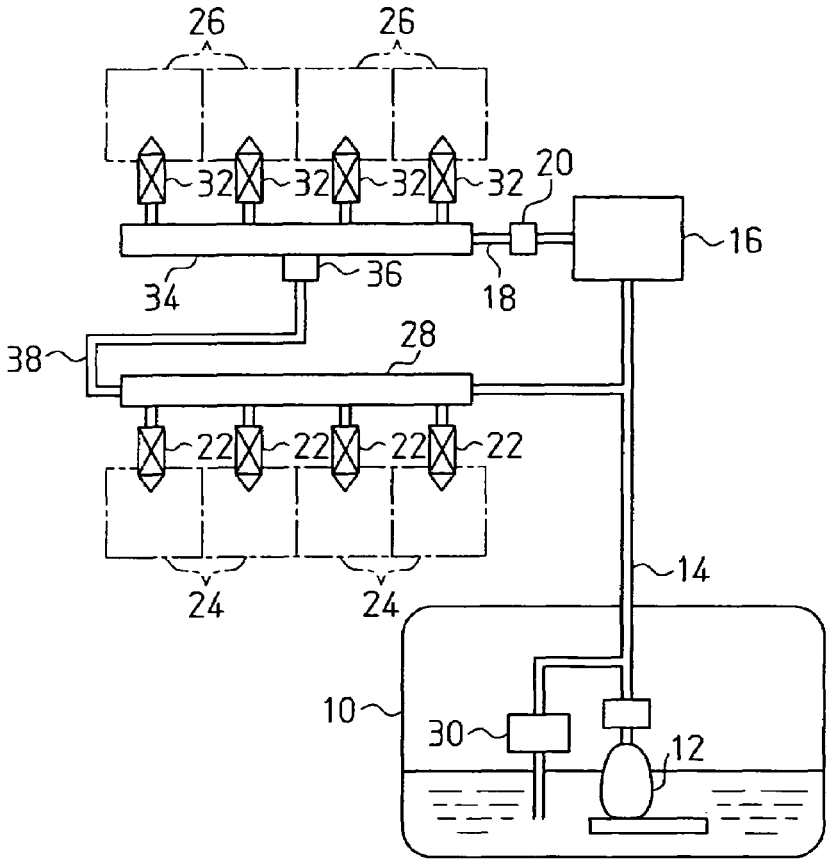
FIG. 1 is a diagram illustrating a fuel supply system of an internal combustion engine according to a preferred embodiment.

As shown in FIG. 1, a feed pump 12 is located in a fuel tank 10, and an outlet of the feed pump 12 is connected to a low pressure fuel passage 14. The feed pump 12 pumps up fuel in the fuel tank 10 and force the fuel into the low pressure fuel passage 14. The feed pump 12 incorporates a check valve, which prevents fuel from flowing backward from the low pressure fuel passage 14 to the fuel tank 10 when the feed pump 12 is stopped.

The internal combustion engine according to the preferred embodiment includes a high pressure fuel pump 16. An inlet of the high pressure fuel pump 16 is connected to the low pressure fuel passage 14, and an outlet of the high pressure fuel pump 16 is connected to a high pressure fuel passage 18 via a check valve 20. The high pressure fuel pump 16 forces fuel in the low pressure fuel passage 14 to the high pressure fuel passage 18. When fuel pressure in the high pressure fuel pump 16 becomes higher than the fuel pressure in the high pressure fuel passage 18 by a degree greater than or equal to a predetermined pressure, the check valve 20 opens to connect the high pressure fuel pump 16 to the high pressure fuel passage 18. In addition, the check valve 20 functions to prevent fuel from flowing backward from the high pressure fuel passage 18 to the high pressure fuel pump 16.

The internal combustion engine is provided with several (four in this embodiment) first injectors 22 for intake passage injection. Each first injector 22 corresponds to one of cylinders 26 and injects fuel in one of intake passages 24 of the internal combustion engine. Each first injector 22 is connected to a common first delivery pipe 28 for intake passage injection, and the first delivery pipe 28 is connected to the low pressure fuel passage 14. Relatively low pressure fuel in the low pressure fuel passage 14 is distributed to each first injector 22 via the first delivery pipe 28. A pressure regulator 30 is provided at the middle of the low pressure fuel passage 14. The pressure regulator 30 makes the pressure in the low pressure fuel passage 14 to be less than or equal to a predetermined pressure.

The internal combustion engine is provided with several (four in this embodiment) second injectors 32 for in-cylinder injection. Each second injector 32 corresponds to one of the cylinders 26 and injects fuel directly into the cylinder 26. Each second injector 32 is connected to a common second delivery pipe 34 for in-cylinder injection, and the second delivery pipe 34 is connected to the high pressure fuel passage 18. High pressure fuel in the high pressure fuel passage 18 is distributed to each second injector 32 via the second delivery pipe 34.

The second delivery pipe 34 is provided with a relief valve 36 for relieving fuel in the second delivery pipe 34. The relief valve 36 is an electromagnetic valve, and opening and closing of the relief valve 36 is switched by electric supply to an electromagnetic solenoid. High pressure fuel in the second delivery pipe 34 is relieved by opening the relief valve 36. The relief valve 36 is basically opened to reduce the fuel pressure in the second delivery pipe 34 when the fuel pressure in the second delivery pipe 34 becomes excessively high.

As described above, the fuel supply system of the preferred embodiment includes two types of injectors, which are the first injectors 22 for intake passage injection, and the second injectors 32 for in-cylinder injection. The fuel supply system supplies fuel to the internal combustion engine by switching between or by the combination of fuel injection from the first injectors 22 and fuel injection from the second injectors 32. The relief valve 36 of the preferred embodiment is connected to the first delivery pipe 28 via a relief passage 38.

When the engine is not operating, the low pressure fuel passage 14 and the first delivery pipe 28, which is connected to the low pressure fuel passage 14, are closed by the feed pump 12, the pressure regulator 30, the high pressure fuel pump 16, and the check valve 20. Therefore, residual fuel in the low pressure fuel passage 14 and the first delivery pipe 28 hardly leaks outside the low pressure fuel passage 14 and the first delivery pipe 28, and is maintained in the accumulated state. That is, when the engine is not operating, the low pressure fuel passage 14 and the first delivery pipe 28 function as a fuel accumulator.

Figure 2:
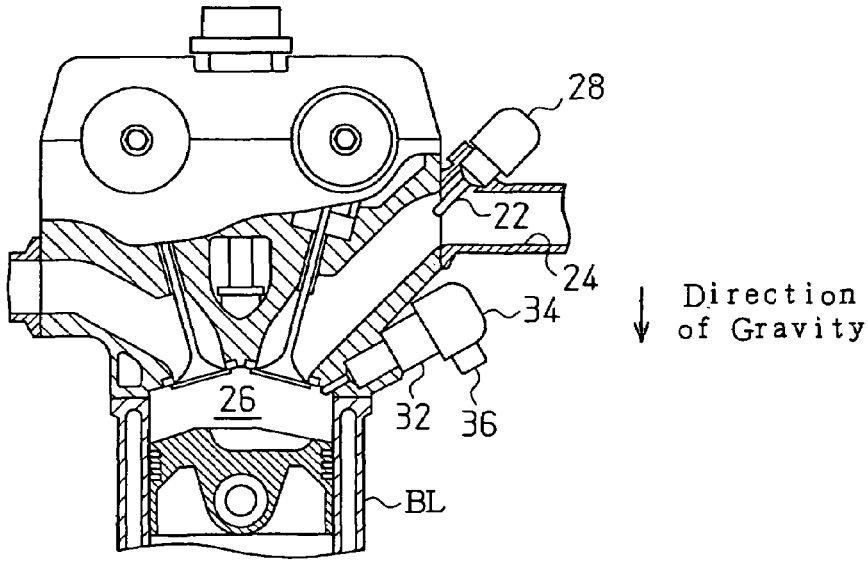
FIG. 2 is a partial cross-sectional view illustrating the internal combustion engine.

As shown in FIG. 2, the second delivery pipe 34 is located in the vicinity of a cylinder block BL where the ambient temperature is high, and the first delivery pipe 28 is located apart from the cylinder block BL where the ambient temperature is relatively low. Therefore, influence of residual heat of the internal combustion engine on the first delivery pipe 28 is small as compared to the second delivery pipe 34, and the temperature increase of fuel in the first delivery pipe 28 does not become a serious problem.

A fuel discharge section of the relief valve 36 is connected to the first delivery pipe 28 via the relief passage 38. Therefore, the fuel discharge section of the relief valve 36 is kept filled with fuel due to the residual fuel in the first delivery pipe 28. Accordingly, if the internal pressure of the second delivery pipe 34 is decreased after the engine is stopped, the second delivery pipe 34 draws in fuel in the fuel discharge section of the relief valve 36. Therefore, air is prevented from entering the second delivery pipe 34 when the engine is not operating without adding a special structure to the fuel supply system.

The first delivery pipe 28 is located higher than the relief valve 36. Therefore, even if air enters the relief passage 38, the entered air moves upward, and fuel in the relief passage 38 easily remains in the vicinity of the relief valve 36 since the specific gravity of air is lighter than fuel. Also, when drawing fuel from the first delivery pipe 28 to the second delivery pipe 34, fuel is smoothly drawn into the second delivery pipe 34 since gravity acts on fuel. Furthermore, in the preferred embodiment, the relief valve 36 is employed that is maintained opened when electric supply is stopped as the engine is stopped. Therefore, when the engine is not operating, the second delivery pipe 34 is connected to the first delivery pipe 28, which is filled with fuel of a relatively low pressure.

Figures 3A, 3B:
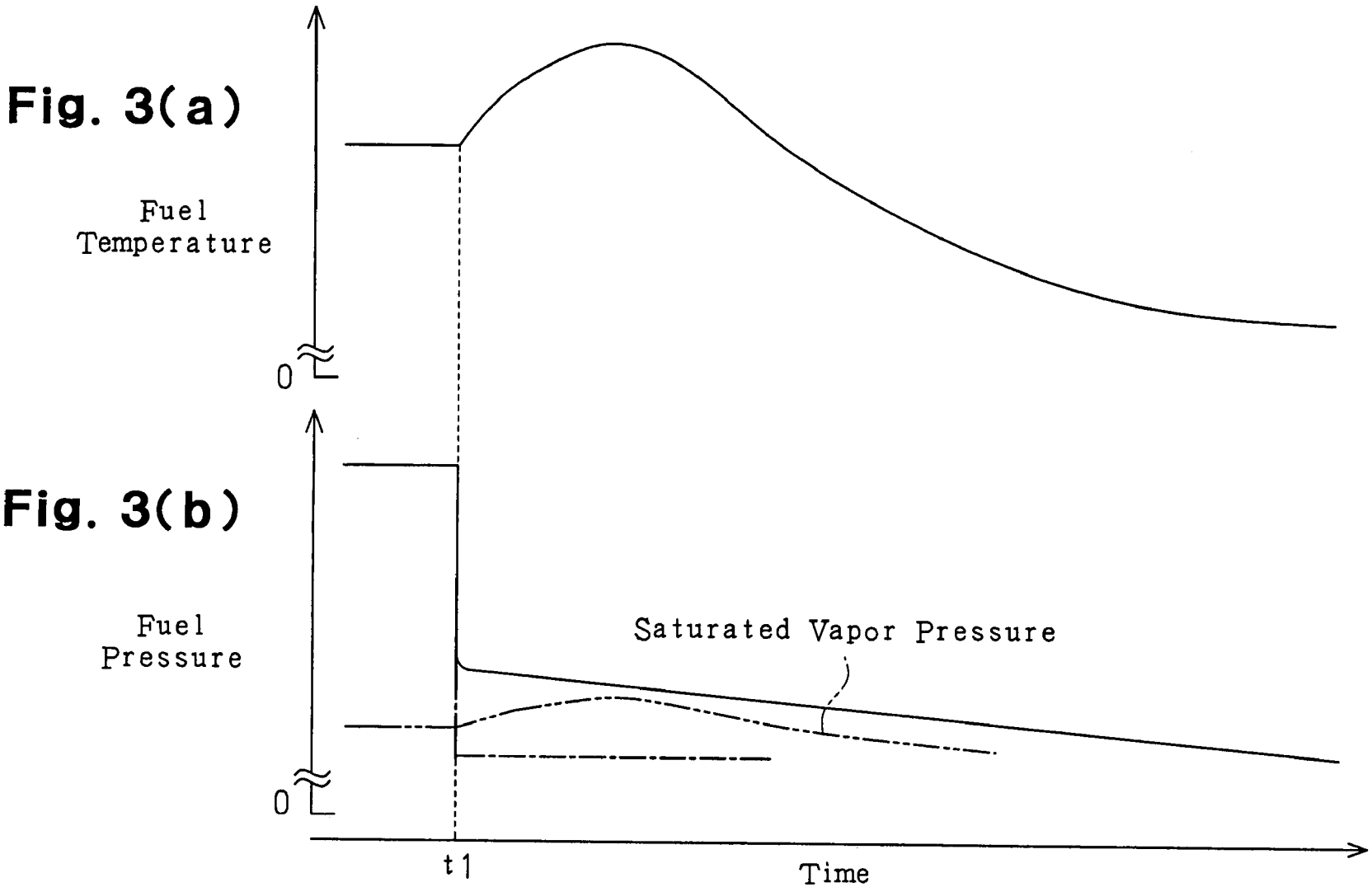
FIG. 3(*a*) is a timing chart showing changes of the temperature of fuel in an in-cylinder injection delivery pipe.

As shown in FIG. 3(*b*), the fuel pressure in the second delivery pipe 34 decreases when the engine is stopped (time t1). Since the second delivery pipe 34 (the high pressure fuel passage 18) is connected to the first delivery pipe 28 (the low pressure fuel passage 14) when the relief valve 36 is opened, the thermal capacity of fuel in the second delivery pipe 34 is increased. Therefore, as shown in FIG. 3(*a*), although the temperature of fuel in the second delivery pipe 34 temporarily increases due to residual heat of the internal combustion engine, the temperature of fuel in the second delivery pipe 34 decreases due to increase of the thermal capacity and the temperature decrease of the internal combustion engine.

In addition , since the fuel discharge section of the relief valve 36 is kept filled with fuel, even if the relief valve 36 is opened when the engine is not operating, air is prevented from entering the second delivery pipe 34 in a suitable manner. The fuel discharge section of the relief valve 36 is reliably kept filled with fuel by fuel accumulated in the first delivery pipe 28, which serves as the fuel accumulator.

A dashed line in FIG. 3(*b*) shows changes of fuel pressure in the second delivery pipe according to a structure in which the relief passage is connected to the fuel tank and the relief valve is kept opened when the engine is stopped. With this structure, when the engine is not operating, the fuel pressure in the second delivery pipe is excessively decreased and becomes lower than the saturated vapor pressure. Therefore, fuel in the second delivery pipe evaporates. In this regard, according to the preferred embodiment, the fuel pressure in the second delivery pipe 34 is decreased while avoiding excessive decrease of the fuel pressure, or more specifically, while maintaining the pressure sufficient for suppressing evaporation of fuel.

The preferred embodiment as described above has the following advantages.

(1) In the preferred embodiment, the fuel discharge section of the relief valve 36 provided on the second delivery pipe 34 is connected to the first delivery pipe 28. Therefore, air is prevented from entering the second delivery pipe 34 without adding a special structure to the fuel supply system.

(2) Since the first delivery pipe 28 is located higher than the relief valve 36, fuel easily remains in the vicinity of the relief valve 36. Therefore, air is more reliably prevented from entering the second delivery pipe 34.

(3) Since the relief valve 36 is maintained opened when the engine is not operating, in addition to preventing air from entering the second delivery pipe 34 when the engine is not operating, the temperature increase and the pressure increase in the second delivery pipe 34 are suppressed.

The preferred embodiment may be modified as follows.

The first delivery pipe 28 may be located lower than the second delivery pipe 34, and the relief passage 38 may be connected to the first delivery pipe 28. With this structure also, advantages are provided that are the same as the advantages (1) and (3).

Instead of the relief valve 36, a valve that operates in accordance with the pressure difference between the internal pressure of the second delivery pipe 34 and the atmospheric pressure, or the pressure difference between the internal pressure of the second delivery pipe 34 and the pressure in the relief passage 38.

Figure 4:
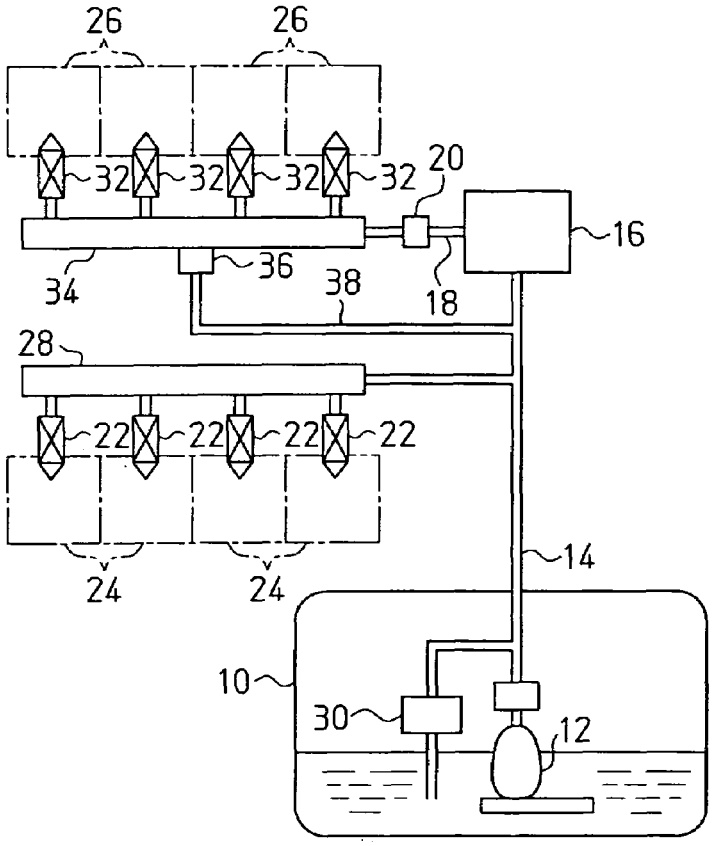
FIG. 4 is a diagram illustrating a fuel supply system of an internal combustion engine according to a modified embodiment.

As shown in FIG. 4, instead of the first delivery pipe 28, the relief passage 38 may be connected to the low pressure fuel passage 14. With this structure, the fuel discharge section of the relief valve 36 is maintained filled with fuel using the fuel accumulated in the low pressure fuel passage 14, which serves as fuel accumulator, without adding a special structure to the fuel supply system. As a result, air is prevented from entering the second delivery pipe 34 in a suitable manner.

Figure 5:
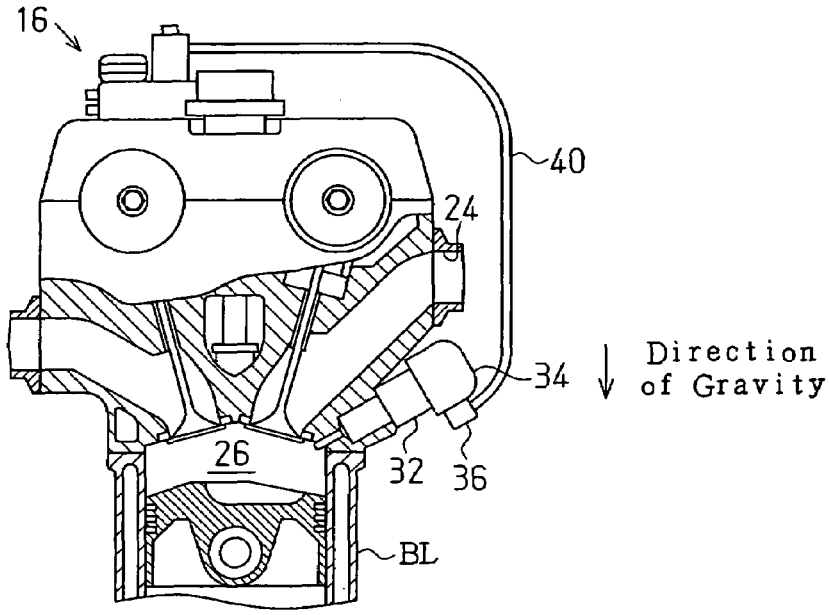
FIG. 5 is a partial cross-sectional view illustrating an internal combustion engine according to a modified embodiment.

A fuel supply system that uses a camshaft pump is known as the high pressure fuel pump. In such a fuel supply system, the high pressure fuel pump is often attached to the upper portion of the cylinder head. When applying the above structure to such a fuel supply system, a relief passage 40 should be connected to an intake section of the high pressure fuel pump 16 as shown in FIG. 5. Therefore, the advantage is provided that is the same as the advantage (2). Furthermore, the structure in which the relief passage 40 is connected to the intake section of the high pressure fuel pump 16 is applicable to a fuel supply system that is not equipped with the first delivery pipe 28 and the first injectors 22 such as a fuel supply system applied to an in-cylinder injection internal combustion engine such as an in-cylinder injection gasoline engine and a common rail diesel engine.

Figure 6:
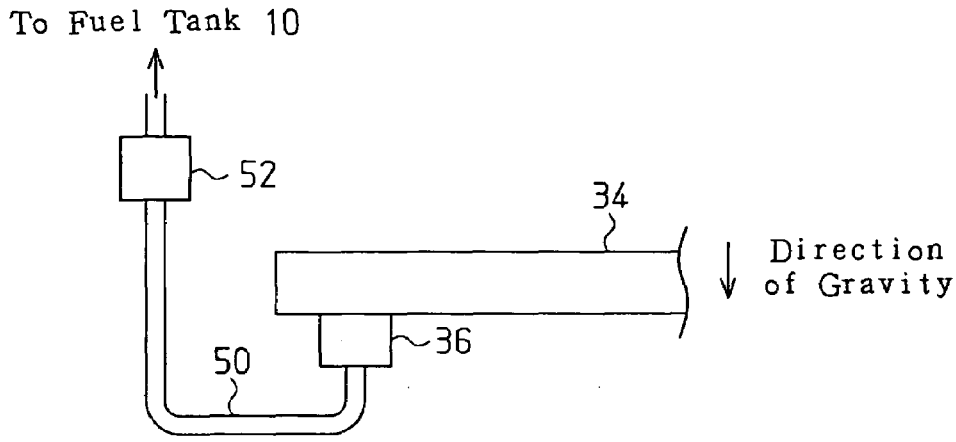
FIG. 6 is a schematic diagram illustrating a relief structure according to a modified embodiment.

As shown in FIG. 6, a relief passage 50 may be connected to the fuel tank 10, and a check valve 52 may be located in the relief passage 50. With this structure, the check valve 52 restricts leakage of fuel from the relief passage 50 between the check valve 52 and the relief valve 36. Therefore, when the engine is not operating, the fuel discharge section of the relief valve 36 is kept filled with fuel. With this structure, the check valve 52 functions as a maintaining device. In the structure in which the relief passage 50 is connected to the fuel tank 10, and the check valve 52 is located in the relief passage 50, the check valve 52 may be located higher than the relief valve 36. With this structure, even if air enters the relief passage 50 between the relief valve 36 and the check valve 52, the entered air moves upward, and fuel in the relief passage 50 easily remains in the vicinity of the relief valve 36.

Figure 7:
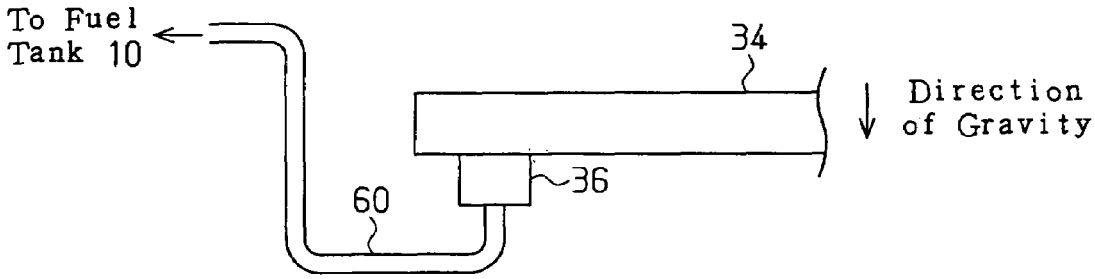
FIG. 7 is a schematic diagram illustrating the arrangement state of a relief passage according to a modified embodiment.
Figure 8:
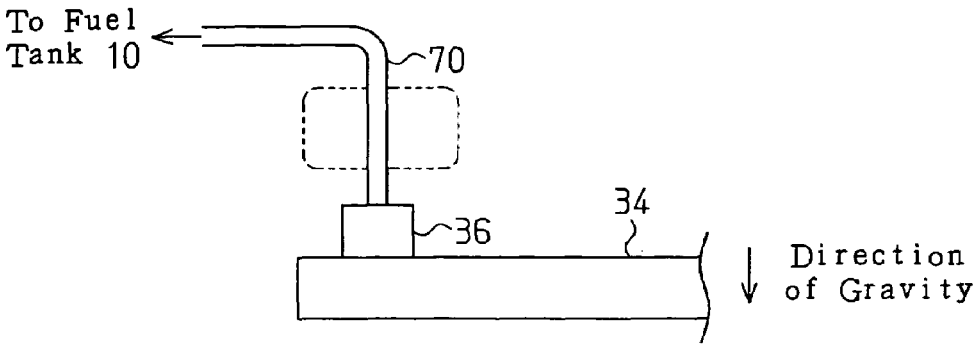
FIG. 8 is a schematic diagram illustrating the arrangement state of the relief passage according to a modified embodiment.

As shown in FIG. 7, a relief passage 60 may be directly connected to the fuel tank 10, and the relief passage 60 may be arranged such that at least part of the relief passage 60 is located higher than the relief valve 36. Also, as shown in FIG. 8, a relief passage 70 may be arranged to extend upward from the relief valve 36. With these structures, at least part of the relief passage is formed to be located higher than the relief valve 36. Therefore, even if fuel leaks from the outlet of the relief passage, fuel remains in a section from a portion of the relief passage located higher than the relief valve 36 to the relief valve 36. Therefore, when the engine is not operating, the fuel discharge section of the relief valve 36 is kept filled with fuel.

The temperature of the residual fuel at the fuel discharge section of the relief valve 36 increases by the residual heat of the internal combustion engine in the same manner as fuel in the second delivery pipe 34. Thus, in a case where the temperature increase of the residual fuel is excessive, the residual fuel might evaporate. In this regard, for example, as shown by a dashed line in FIG. 8, part of the relief passage 70 may be formed to have a large cross-section so that fuel accumulates in the large cross-section portion. This increases the thermal capacity of fuel. As a result, the temperature increase of fuel is suppressed, which suppresses evaporation of fuel.

The present invention is applicable to a fuel supply system of an intake passage injection gasoline engine as long as the fuel supply system has a delivery pipe provided with a relief valve.

The invention claimed is:

1. A fuel supply system of an internal combustion engine including a feed pump, a high pressure fuel pump and a delivery pipe, the delivery pipe including a first delivery pipe for intake passage injection, a second delivery pipe for incylinder injection and a relief valve, the fuel supply system comprising:

a maintaining device, which maintains a fuel discharge section of the relief valve filled with fuel when the engine is not operating; and a low pressure fuel passage, which connects the feed pump to the high pressure fuel pump, and a high pressure fuel passage, which connects the high pressure fuel pump to the delivery pipe, wherein the fuel discharge section of the relief valve is connected to a fuel accumulator and the maintaining device is configured of the fuel accumulator, the fuel accumulator is located higher than the relief valve, the second delivery pipe is provided with the relief valve, and the first delivery pipe is configured of the fuel accumulator.

2. The fuel supply system according to claim 1, wherein the relief valve is maintained opened when the engine is not operating.

3. An internal combustion engine having a plurality of cylinders and intake passages each of which connected to one of the cylinders, the internal combustion engine comprising:

a plurality of first injectors each of which injects fuel in one of the intake passages;

a plurality of second injectors each of which injects fuel in one of the cylinders, wherein the first and second injectors are used independently or in combination;

a first delivery pipe for distributing fuel to the first injectors;

a second delivery pipe for distributing fuel to the second injectors;

a relief valve provided on the second delivery pipe;

a relief passage, which connects the relief valve to the first delivery pipe; and a maintaining device, which maintains a fuel discharge section of the relief valve filled with fuel when the engine is not operating.

4. The internal combustion engine according to claim 3, wherein a fuel discharge section of the relief valve is connected to a fuel accumulator, and the maintaining device is configured of the fuel accumulator.

5. The internal combustion engine according to claim 4, wherein the fuel accumulator is located higher than the relief valve.

6. The internal combustion engine according to claim 4, further comprising:

a feed pump;

a high pressure fuel pump;

a low pressure fuel passage, which connects the feed pump to the high pressure fuel pump; and a high pressure fuel passage, which connects the high pressure fuel pump to the delivery pipe, wherein the fuel accumulator is configured of the low pressure fuel passage.

7. The internal combustion engine according to claim 4, wherein the first delivery pipe is configured of the fuel accumulator.

8. The internal combustion engine according to claim 4, wherein the relief valve is maintained opened when the engine is not operating.

9. An internal combustion engine having a plurality of cylinders and intake passages each of which connected to one of the cylinders, the internal combustion engine comprising:

a plurality of first injectors each of which injects fuel in one of the intake passages;

a plurality of second injectors each of which injects fuel in one of the cylinders, wherein the first and second injectors are used independently or in combination;

a first delivery pipe for distributing fuel to the first injectors;

a second delivery pipe for distributing fuel to the second injectors;

a relief valve provided on the second delivery pipe;

a fuel tank;

a relief passage, which connects the relief valve to the fuel tank; and a maintaining device, which maintains a fuel discharge section of the relief valve filled with fuel when the engine is not operating, wherein at least part of the relief passage is located higher than the relief valve, and the maintaining device is configured of said at least part of the relief passage.

10. An internal combustion engine having a plurality of cylinders and intake passages each of which connected to one of the cylinders, the internal combustion engine comprising:

a plurality of first injectors each of which injects fuel in one of the intake passages;

a plurality of second injectors each of which injects fuel in one of the cylinders, wherein the first and second injectors are used independently or in combination;

a first delivery pipe for distributing fuel to the first injectors;

a second delivery pipe for distributing fuel to the second injectors;

a relief valve provided on the second delivery pipe;

a fuel tank;

a relief passage, which connects the relief valve to the fuel tank; and a maintaining device, which maintains a fuel discharge section of the relief valve filled with fuel when the engine is not operating, wherein the relief passage is provided with a check valve, and the maintaining device is configured of the check valve.

11. The internal combustion engine according to claim 10, wherein the check valve is located higher than the relief valve.

* * * * *